US007066247B2

(12) United States Patent
Butler et al.

(10) Patent No.: US 7,066,247 B2
(45) Date of Patent: Jun. 27, 2006

(54) METHODS AND APPARATUS FOR DRILLING WITH A MULTIPHASE PUMP

(75) Inventors: Bryan V. Butler, Garrison, TX (US); Gregory H. Chitty, Houston, TX (US); Darcy Nott, Calgary (CA); Jeffrey C. Saponja, Calgary (CA); Peter B. Moyes, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/225,466

(22) Filed: Sep. 13, 2005

(65) Prior Publication Data

US 2006/0005999 A1 Jan. 12, 2006

Related U.S. Application Data

(62) Division of application No. 10/606,652, filed on Jun. 26, 2003, now Pat. No. 6,966,367.

(51) Int. Cl.
*E21B 43/00* (2006.01)

(52) U.S. Cl. ..... 166/105; 166/105.5

(58) Field of Classification Search ..... 166/105–105.5, 166/351, 368, 383, 54.1, 67, 68, 70, 72
See application file for complete search history.

(56) References Cited

U.S. PATENT DOCUMENTS 2,894,585 A * 7/1959 Erwin ..... 166/301
4,368,787 A * 1/1983 Messenger ..... 175/319
4,479,558 A * 10/1984 Gill et al. ..... 175/320
4,630,691 A * 12/1986 Hooper ..... 175/65
4,744,426 A * 5/1988 Reed ..... 175/102
6,102,673 A 8/2000 Mott et al.
2002/0066596 A1 6/2002 Judge et al.

FOREIGN PATENT DOCUMENTS

GB 2389130 12/2003
GB 2393988 4/2004

OTHER PUBLICATIONS

GB Examination Report, Application No. GB0413486.2, dated Jan. 5, 2006.

* cited by examiner

*Primary Examiner*—Frank S. Tsay
(74) *Attorney, Agent, or Firm*—Patterson & Sheridan LLP

(57) ABSTRACT

The present invention generally relates to an apparatus and method for removing hydrocarbons and other material from a wellbore. In one aspect, a method of drilling a sub-sea wellbore is provided. The method includes circulating a drilling fluid through a drill string from a surface of the sea to a drill bit in the wellbore. The method further includes pumping the fluid and drill cuttings from the sea floor to the surface with a multiphase pump having at least two plungers operating in a predetermined phase relationship. In another aspect, a fluid separator system having a first and a second plunger assembly is provided. The fluid separator system includes at least one fluid line for removing a fluid portion from the at least one plunger assembly and at least one gas line for removing gas from the first and a second plunger assembly.

28 Claims, 11 Drawing Sheets

METHODS AND APPARATUS FOR DRILLING WITH A MULTIPHASE PUMP

CROSS-REFERENCE TO RELATED APPLICATIONS

This application is a divisional of U.S. patent application Ser. No. 10/606,652, filed Jun. 26, 2003 now U.S. Pat. No. 6,966,367, which claims benefit of U.S. patent application Ser. No. 10/156,722, filed May 28, 2002, now U.S. Pat. No. 6,837,313, which claims benefit of U.S. patent application Ser. No. 09/914,338, filed Feb. 25, 2000, now U.S. Pat. No. 6,719,071. Each of the aforementioned related patent applications is herein incorporated by reference.

BACKGROUND OF THE INVENTION

1. Field of the Invention

The present invention generally relates to apparatus and methods used to transport hydrocarbons from a wellbore to another location. More particularly, the invention relates to a multiphase pump for removing hydrocarbons and other material from the wellbore.

2. Description of the Related Art

In a conventional onshore, under-balanced drilling operation, a wellbore is formed in the earth to access hydrocarbon bearing formations. During the drilling operation, a relatively light weight medium with a gas constituent is circulated through the wellbore to cool the drill bit and remove cuttings from the wellbore. The drilling material, gas, and cuttings, which are referred to here as "wellbore fluid" is circulated back to the surface of the wellbore. The wellbore fluid is then transported by a flowline to a separator where it may be separated into gas, liquids, and solids. If the wellbore fluid does not have adequate energy to flow to the separator, it may be pumped by a multiphase pump. These pumps are capable of moving volumes of the oil, gas, water, solids, and other substances making up the wellbore fluid. The multiphase pumps can be connected to a single or multiple wellheads through the use of a manifold. An exemplary multiphase pump is described in U.S. patent application Ser. No. 10/036,737, filed on Dec. 21, 2001, which is herein incorporated by reference in its entirety.

Currently, the under-balanced drilling operation requires at least one large separator to be present on location to handle the wellbore fluid during the drilling operation. The gas phase is separated and then usually flared or re-injected into the wellbore while the solid and liquid phases are captured for re-use and/or disposal. While the separator does its job effectively, it is costly to rent, transport, and personnel costs on location are high. Additionally, the physical size of the separator occupies valuable well site real estate that could be used for other necessary oilfield equipment.

There is a need therefore for more space and a cost efficient method and apparatus to handle gas bearing wellbore fluid.

In a conventional offshore drilling operation, a floating vessel and a riser pipe are used to connect surface drilling equipment to a sub-sea wellhead located at the sea floor. The riser pipe is typically filled with returning drilling fluid resulting in a relatively large hydrostatic pressure due to the length of the riser. This hydrostatic pressure in the riser, combined with additional pressure brought about by the circulation friction of the fluid, combines to form an equivalent circulating density "ECD". In some instances, the ECD can exceed the fracture pressure of the formation adjacent the wellbore permitting drilling fluids to enter the formation.

Permanent damage to the formation and loss of expensive drilling fluid is a typical result of fracturing the formation due to the effects of ECD.

The oilfield industry has attempted to solve the ECD problem in offshore drilling operations with an operation known as "pump and dump". In this arrangement, the cuttings and mud used to drill the sub-sea wellbore are not returned in a riser but are separated at the sea floor. The mud is returned to the surface of the well via a separate line while the solids are allowed to flow out on to the seabed and remain there.

Recently, another method has been developed to reduce the effects of hydrostatic pressure in an offshore drilling operation. In one such arrangement, described in U.S. Pat. No. 6,505,691, filed by Judge on Aug. 6, 2001, a diaphragm type pump is used on the floor of the sea to transport drilling fluid, including solids to the surface of the sea. While the pump is capable of pumping solids and liquids, its volume is limited by its design requiring a high number of pump cycles to move a typical volume of fluid produced from the wellbore.

There is a need, therefore, for a cost effective method and apparatus to reduce the hydrostatic and ECD related pressures in an offshore drilling operation. There is a further need for a method and an apparatus to effectively return multiphase material to the surface while drilling a sub-sea well. There is yet a further need for a cost effective method and an apparatus for separating a gas portion of wellbore fluid from a liquid portion thereof.

SUMMARY OF THE INVENTION

The present invention generally relates to an apparatus and method for removing hydrocarbons and other material from a wellbore. In one aspect, a method of drilling a sub-sea wellbore is provided. The method includes circulating a drilling fluid through a drill string from a surface of the sea to a drill bit in the wellbore. The method further includes pumping the fluid and drill cuttings from the sea floor to the surface with a multiphase pump having at least two plungers operating in a predetermined phase relationship.

In another aspect, a fluid separator system having a first and a second plunger assembly is provided. The fluid separator system includes at least one fluid line for removing a fluid portion from the at least one plunger assembly and at least one gas line for removing gas from the at least one plunger assembly.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope for the invention may admit to other equally effective embodiments.

DETAILED DESCRIPTION

The present invention generally relates to a multi-phase pump for use in forming a wellbore. In one aspect, the multi-phase pump is located on a sea floor to facilitate the removal of circulating fluid and cuttings by returning the fluid and cuttings to a platform or a floating vessel. In another aspect of this invention, the multi-phase pump may be employed in an underbalanced drilling operation of an onshore wellbore. In this aspect, the multi-phase pump removes hydrocarbons and separates the gas portion from the liquid portion.

Figure 1:
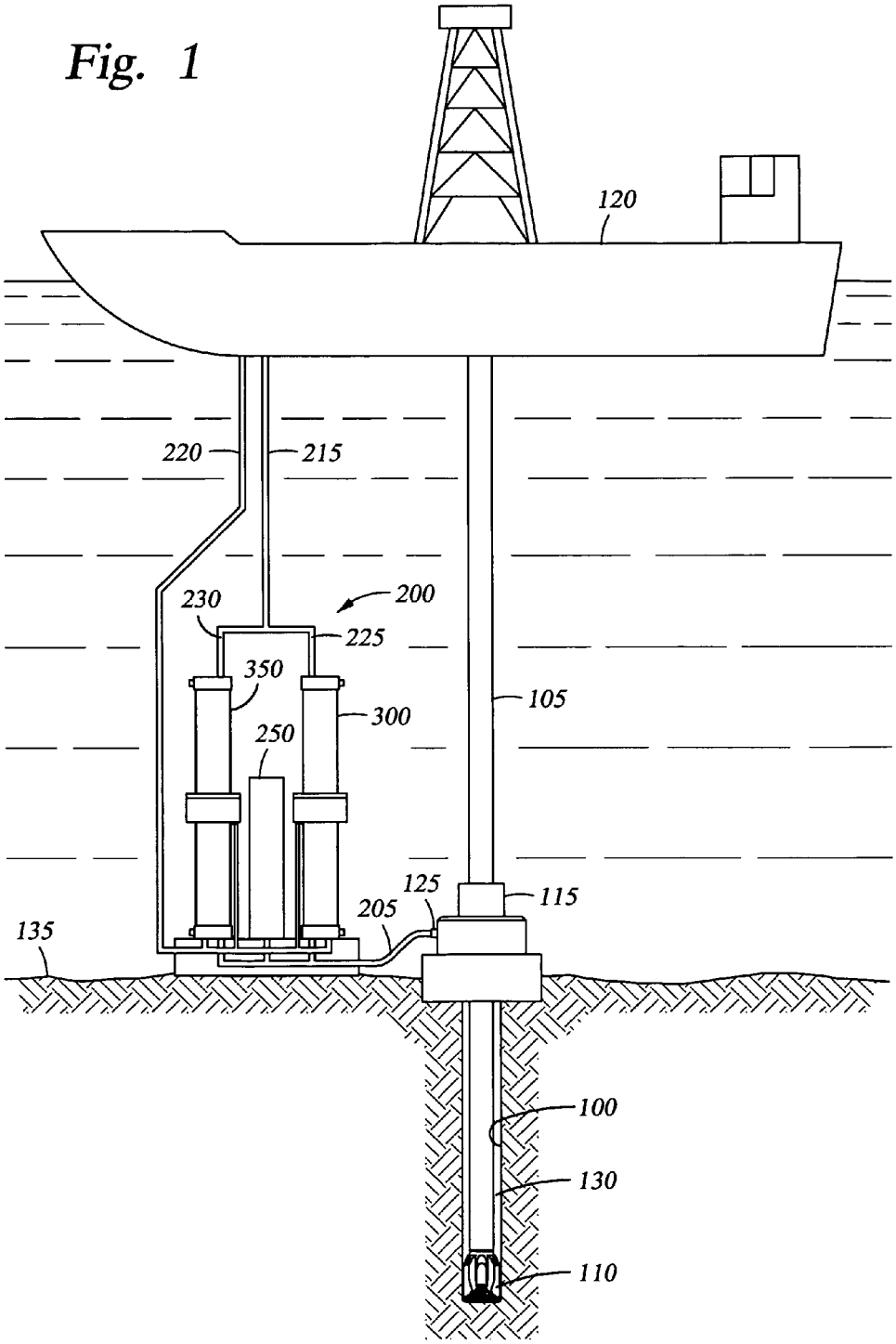
FIG. 1 is a cross-sectional view illustrating a multi-phase pump of this present invention disposed on the sea floor adjacent to a sub-sea wellbore.

FIG. 1 is a cross-sectional view illustrating a multi-phase pump 200 of the present invention disposed on a sea floor 135 adjacent to a sub-sea wellbore 100. Although the drilling system in FIG. 1 shows only one multi-phase pump 200 disposed on the sea floor 135, any number of pumps may be employed in accordance with this present invention. Additionally, by using vertical plunger assemblies 300, 350 which may be referred to as fluid pumps, the equipment can be mounted on a standard guide base, or alternately, be mounted integrally to a special riser joint as discussed in a subsequent paragraph. Furthermore, by employing vertical stabs, these plunger assemblies 300, 350 may individually be run into place or individually retrieved. For ease of explanation, this aspect of the invention will first be described generally with respect to FIG. 1, thereafter more specifically with FIGS. 2–7.

Also shown in FIG. 1, a drill string 105 with a drill bit 110 at a lower end thereof extending upwards to a floating vessel 120. A rotating control head 115 seals the rotating drill string 105. Additionally, other components may be located at the sea floor to protect against a blow out such as a shear (not shown) and a ram (not shown). An annulus 130 is formed between the wellbore 100 and the drill string 105 and provides a passageway for removal of drill cuttings and mud during the formation of the wellbore 100.

An outlet 125 disposed below the rotating control head 115 connects the annulus 130 to a fluid passageway 205. The fluid passageway 205 provides fluid communication between the annulus 130 and the multi-phase pump 200. As the drill cuttings, mud, and other fluid all of which will be referred to as "wellbore fluid" exits the wellbore 100, they are urged through the fluid passageway 205 by circulation pressure. Thereafter, the wellbore fluid is pumped via the multiphase pump 200 through a discharge line 220 to the floating vessel 120 where the wellbore fluid can be separated, reused, or properly disposed of by means known in the art.

A high-pressure power fluid is supplied through a high pressure fluid line 215 to operate the multiphase pump 200. Typically, the power fluid is seawater that is pumped from the floating vessel 120 to the multiphase pump 200 at an initial operating pressure. As the seawater travels through the line 215, the seawater increases in pressure due to a pressure gradient force of the seawater. After use by the multi-phase pump 200, the high pressure seawater is expelled to the sea, eliminating the need to bring it back to the surface. Alternatively, another power fluid with a higher pressure gradient force than seawater may be employed with the multiphase pump 200. Such an alternative power fluid can increase the efficiency of the system by reducing the required amount of initial operating pressure supplied by the floating vessel 120.

As shown in FIG. 1, the high pressure fluid line 215 supplies power fluid to either one of the plunger assemblies 300, 350 during the pumping cycle. For instance, as the first plunger assembly 300 is expelling wellbore fluid into the discharge line 220, the fluid line 215 will supply power fluid to assembly 300 via a fluid line 225. Conversely, as the second plunger assembly 350 is expelling wellbore fluid into the discharge line 220, the fluid line 215 will supply power fluid to second plunger assembly 350 via a fluid line 230.

The embodiment illustrated in FIG. 1 is arranged for a top hole drilling operation. Generally, top hole drilling maintains a required wellbore pressure gradient in a riserless drilling mode, using the rotating control head 115 and the multiphase pump 200 to mitigate various pressure related geotechnical hazards at shallow penetration depths, such as pressured water and gas sands. Additionally, top hole drilling mitigates mud loss and formation fracturing by controlling the pressure on the wellbore 100 using the multiphase pump 200 as a choke and a lift pump to reduce the hydrostatic pressure effect of a mud column. Typically, the top hole drilling operation forms the wellbore 100 to predetermined depth before arriving at the target hydrocarbons. Therefore, the top hole drilling operation requires minimal sub-sea wellbore equipment, such as the rotating control head 115, to isolate the wellbore 100 from the sea.

Figure 2:
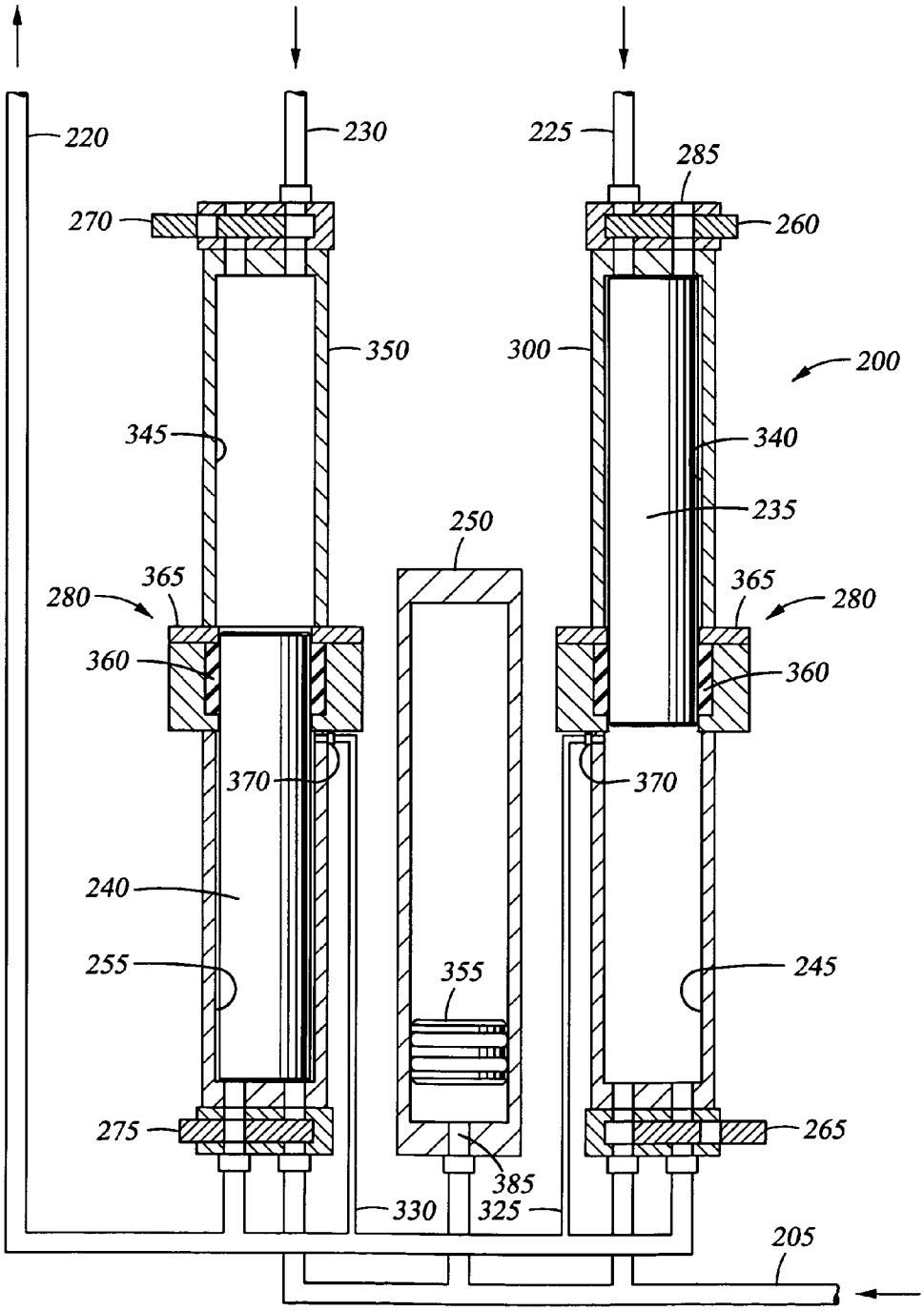
FIG. 2 is a cross-sectional view illustrating the multiphase pump communicating wellbore fluid to a discharge line during a pump cycle.

FIG. 2 is a cross-sectional view illustrating the multiphase pump 200 communicating wellbore fluid to the discharge line 220 during a pump cycle. The multiphase pump 200 contains a first plunger 235 and a second plunger 240, each movable between an extended position and a retracted position within the plunger assemblies 300, 350, respectfully. A first lower valve 265 and a first upper valve 260 controls the movement of the first plunger 235 while the movement of the second plunger 240 is controlled by a second lower valve 275 and a second upper valve 270. Preferably, the valves 260, 265, 270, 275 are slide valves and can operate even in the presence of solids. In other words, the valves 260, 265, 270, 275 are constructed and arranged to permit solids to pass through the valve while open but will break up solids if necessary to effectively close.

The valves 260, 265, 270, 275 are synchronized and typically operated by a sub-sea pilot valve (not shown). During operation, the lower valves 265, 275 allow wellbore fluid from the fluid passageway 205 to fill and vent the first lower chamber 245 and a second lower chamber 255, respectfully. The upper valves 260, 270 allow high pressure power fluid from the fluid lines 225, 230 to fill and vent a first upper chamber 340 and a second upper chamber 345, respectfully.

As shown in FIG. 2, the first plunger 235 moves toward the extended position as wellbore fluid and pressure enters through the valve 265 to fill the first lower chamber 245 with fluid from the fluid passageway 205. In this embodiment, the pressurized, circulating drilling fluid is used to urge the plunger 235 upward. At the same time, power fluid in the first upper chamber 340 vents through an outlet 285 of the upper valve 260 into the surrounding sea. Simultaneously, the second plunger 240 moves in an opposite direction toward the retracted position as power fluid from the fluid line 230 flows through valve 270 and fills the upper chamber 345, thereby expelling the wellbore fluid in the second lower chamber 255 through the lower valve 275 and into the discharge line 220. As the first plunger 235 reaches its full extended position, the second plunger 240 reaches its full retracted position, thereby completing a cycle. The first plunger 235 then moves toward the retracted position as power fluid from the fluid line 225 flows through the valve 260 and fills the upper chamber 340, thereby expelling the wellbore fluid in the lower chamber 245 into the discharge line 220, as the second plunger 240 moves toward the extended position filling the second lower chamber 255 with wellbore fluid from the passageway 205. In this manner, the plungers operate as a pair of substantially counter-synchronous fluid pumps. While the described embodiment includes plungers acting in a counter-synchronous manner, it will be understood that so long as they move in a predetermined way relative to one another, a predetermined phase relationship, the plungers can assume any position as they operate.

Preferably, the plungers 235, 240 move in opposite directions causing continuous flow of fluid from the fluid passageway 205 to the discharge line 220. However, as the plungers 235, 240 change direction, the plungers 235, 240 will slow down, stop, and accelerate in the opposite direction. This pause of the plungers 235, 240 could introduce undesirable changes in the back pressure on the annulus of the sub-sea wellbore (not shown), since the inlet flow passageway 205 is directly connected to the flow of fluid and solids coming up the wellbore. Therefore, a pulsation control assembly 250 is employed in the multiphase pump 200 to control backpressure due to change of direction of plungers 235, 240 during the pump cycle.

Generally, the pulsation control assembly 250 is a gas filled accumulator that is connected to the inlet line of both plunger assemblies 300, 350 by a pulsation port 385. During normal flow, the in flow pressure will enter through the port 385 and slightly fill the pulsation control assembly 250. As the first plunger 235 starts to slow down near the end of its stroke, the flow coming from the wellbore annulus will increase its pressure slightly driving an accumulator piston 355 further up and into pulsation control assembly 250 as it tries to balance pressures across the piston 355. As the first plunger 235 stops, the opposite plunger 240 begins to increase its intake speed, causing the inlet pressure to drop slightly, which will allow the stored fluid in the pulsation control assembly 250 to come back out through port 385. This process will repeat itself throughout the pump cycle as each plunger reverses stroke.

A single seal assembly 280 is disposed around the plungers 235, 240 to accommodate fluid and solids as well as seawater. This seal assembly 280 includes a method to constantly scrape and polish the plungers 235, 240, and can eliminate solid particles from the seal assembly 280 area thereby insuring its useful life and protecting the sealing elements. Generally, the seal assembly 280 includes a plurality of rings 365 that are disposed on either side of a sealant 360. During the operation of the multi-phase pump 200, the rings 365 scrape and polish the plungers 235, 240. Typically, the sealant 360 is replenished by a mechanism well known in the art. Alternatively, the sealant may also be remotely injected during pump operations to replenish and improve its life expectancy.

The multi-phase pump 200 further includes a first gas line 325 and a second gas line 330 disposed on the first plunger assembly 300 and second plunger assembly 350, respectfully. Generally, the gas lines 325, 330 are used to prevent gas lock of the plungers 235, 240 during operation of the multi-phase pump 200. As shown, the first gas line 325 connects an auxiliary gas port 370 at the upper end of the lower chamber 245 to the discharge line 220. Similarly, the second gas line 330 connects an auxiliary gas port 375 at the upper end of the lower chamber 255 to the discharge line 220. As will be discussed in greater detail in FIGS. 3A–3E, gas entering the multiphase pump 200 from the fluid passageway 205 will be compressed by the plungers 235, 240 and thereafter expelled from the lower chambers 245, 255 through the ports 370 into the discharge line 220.

FIGS. 3A–3E illustrates cross-sectional views of an anti-gas lock arrangement employed in a plunger assembly 400. For clarity, the anti-gas lock arrangement will be illustrated on a single plunger assembly 400. However, it should be noted that this anti-lock arrangement may apply to any number of plunger assemblies and applies equally to the first plunger assembly 300 and second plunger assembly 350 as discussed in FIGS. 1 and 2.

Figure 3A:
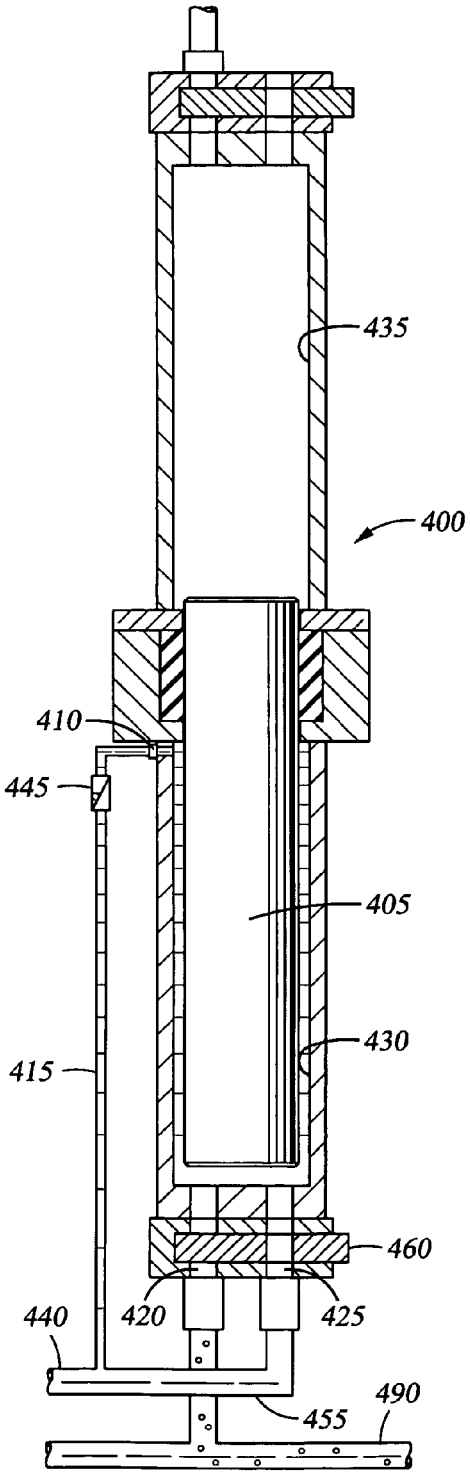
FIG. 3A is a cross-sectional view illustrating a plunger assembly with a plunger in a retracted position.
Figure 3B:
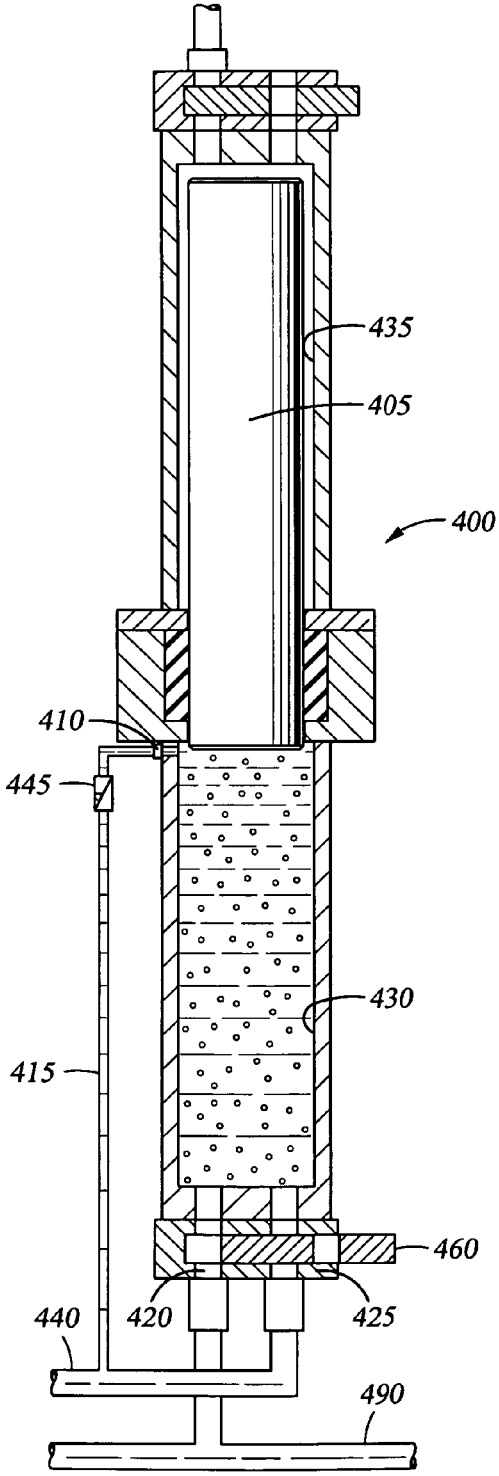
FIG. 3B is a cross-sectional view illustrating the plunger assembly with the lower chamber filled with wellbore fluid.

FIG. 3A is a cross-sectional view illustrating a plunger assembly 400 with a plunger 405 in a retracted position. The plunger 405 moves from the retracted position to the extended position as wellbore fluid from the wellbore line 440 enters through inlet 420 to fill a lower chamber 430 as illustrated in FIG. 3B. As wellbore fluid enters the chamber 430, the vertical disposition of the plunger assembly 400 disposes the solids and liquids to remain at or near the lower portion of the chamber 430. As plunger 435 descends, it compresses the gas by displacing the liquids around the plunger 435. Finally the pressure equals the discharge pressure in line 440 and further compression efforts will cause the gas to flow out through line 415 and into line 440. As the plunger 435 continues to descend, the displaced liquid will rise around the plunger 435 to follow the gas through port 410, which will cause a further rise in the chamber pressure. This will open the main port 425, and the remaining liquids and any solids will discharge through port 425 into line 440.

Figure 3C:
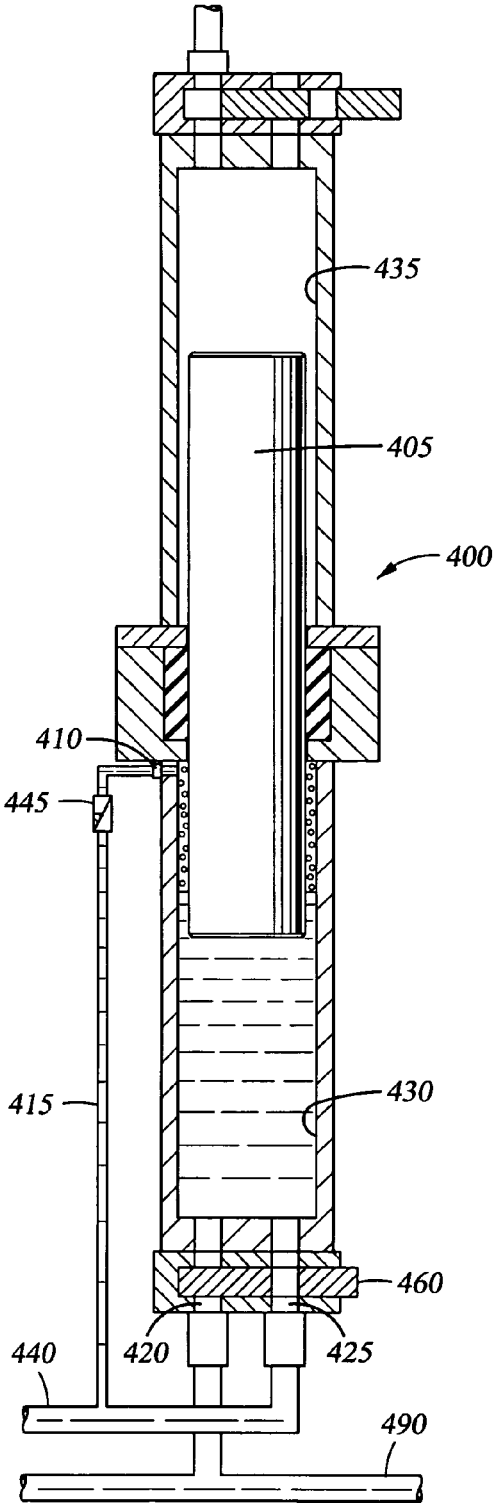
FIG. 3C illustrates the pressurizing of the gas as the plunger moves toward the retracted position.

FIG. 3C illustrates the pressurizing of the gas as the plunger 405 moves toward the retracted position. Generally, a force is applied at the upper end of the plunger 405 causing the plunger 405 to move axially downward. The force may be supplied by the introduction of power fluid into the upper chamber 345 as discussed in a previous paragraph or by any other means well known in the art. The downward movement of the plunger 405 compresses the gas at the upper end of the lower chamber 430.

Figure 3D:
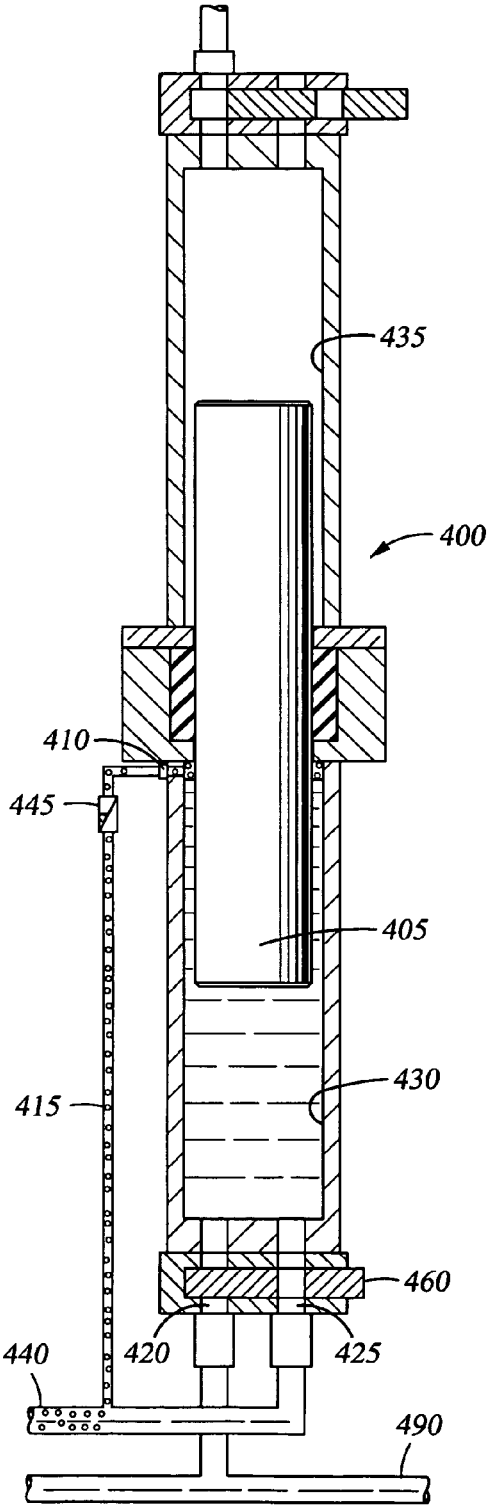
FIG. 3D illustrates the pressurized gas venting from the lower chamber into a gas line and subsequently into the discharge line.

FIG. 3D illustrates the pressurized gas venting from the lower chamber 430 into a gas line, 415 and subsequently into the discharge line 440. The plunger 405 compresses the gas until the gas pressure equals the discharge pressure. At this point, a valve 445 opens up allowing gas to enter the gas line 415. Thereafter, the gas flows through the gas line 415 into the discharge line 440.

Figure 3E:
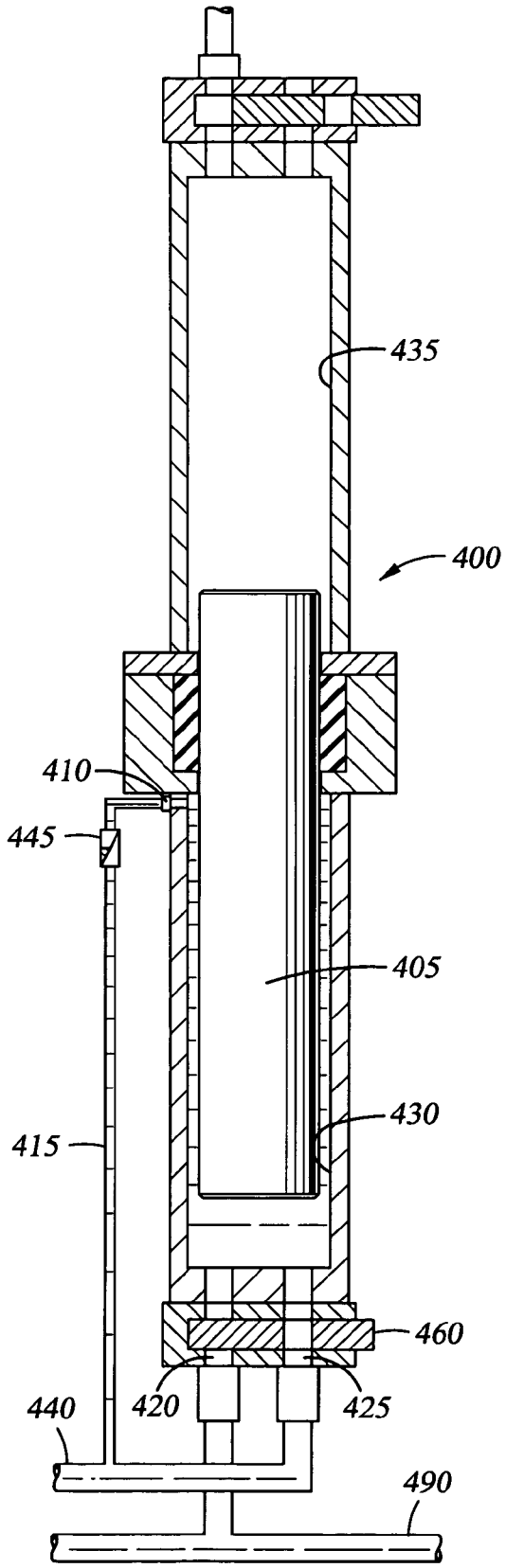
FIG. 3E illustrates fluid venting from the lower chamber through the gas line and the fluid line.

FIG. 3E illustrates fluid venting from the lower chamber 430 through the gas line 415 and the fluid line 455. After the gas is vented from the lower chamber 430, the liquid enters the gas line 415 through the valve 445 causing an increase in the chamber pressure. Thereafter, valve 460 opens allowing any remaining liquid in the lower chamber 430 to enter the discharge line 440. Eventually, the plunger 405 reaches the retracted position as shown in FIG. 3A thus completing a pump cycle.

Figure 4:
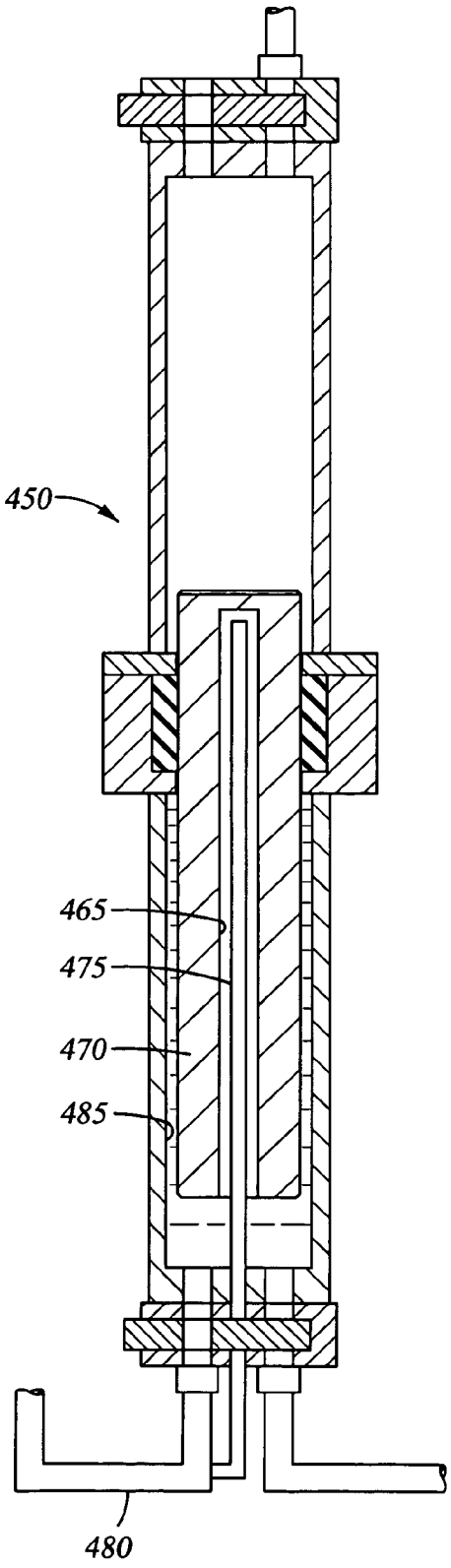
FIG. 4 is an alternative embodiment of a gas anti-lock arrangement for use with a plunger assembly.

FIG. 4 is an alternative embodiment of a gas anti-lock arrangement for use with a plunger assembly 450. In a similar manner as described in FIGS. 3A–3E, the plunger assembly 450 pressurizes the gas in a lower chamber 485 as a plunger 470 moves toward the retracted position. However in this embodiment, an internal gas tube 475 is disposed in a plunger chamber 465 to communicate the pressurized gas to a discharge line 480 instead of an external gas line. Generally, wellbore fluid and pressure enters the chamber 485 to move a plunger 470 toward the extended position. The vertical disposition of the plunger assembly 450 naturally separates the fluids from the gas by disposing the solids and liquids at or near the lower portion of the chamber 485 while collecting the gas at the upper portion of the plunger chamber 465. As the plunger 470 moves towards the retracted position, the gas becomes pressurized. When the gas pressure equals the discharged pressure, the gas is communicated through the tube 475 to the discharge line 480. Thereafter, the liquid portion flows through the tube 475 to urge any remaining gas in the tube 475 into the discharge line 480. This sequence of events occurs throughout the pump cycle.

Figure 5:
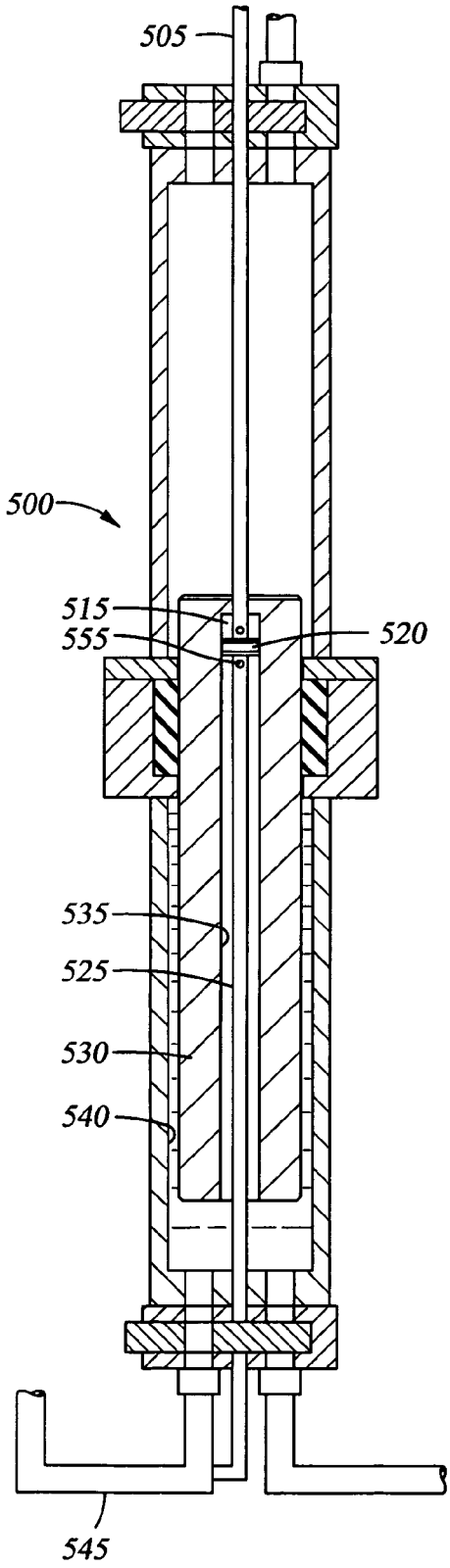
FIG. 5 is a cross-sectional view illustrating an alternative embodiment of a plunger assembly with an internal piston and position control.

FIG. 5 is a cross-sectional view illustrating an alternative embodiment of a plunger assembly 500. In a similar manner as described in FIG. 4, the plunger assembly 500 utilizes a gas tube 525 to communicate gas from a plunger chamber 535 to a discharge line 545. However, a hydraulic arrangement is utilized to move a plunger 530 to the extended position instead of relying solely on wellbore fluid as described in the previous embodiments. The hydraulic arrangement includes a hydraulic chamber 515 disposed at the upper end of the plunger 530. The hydraulic chamber 515 is separated from the gas tube 525 by a seal arrangement 520. Thus, as the hydraulic chamber 515 fills with fluid from a control line 505, the fluid becomes pressurized, thereby creating a force on the plunger 530. This fluid force urges the plunger 530 axially upward toward the extended position. At the same time, wellbore fluid enters and fills the lower chamber 540. After the plunger 530 reaches the extended position, the plunger 530 reverses direction and moves toward the retracted position displacing the fluid in the chamber 515 through the control line 505. Shortly thereafter, the pressurized gas in the plunger chamber 535 is communicated through a port 555 into the gas tube 525 and subsequently into the discharge line 545. This sequence of events occurs repeatively as the pump cycles.

Figure 6:
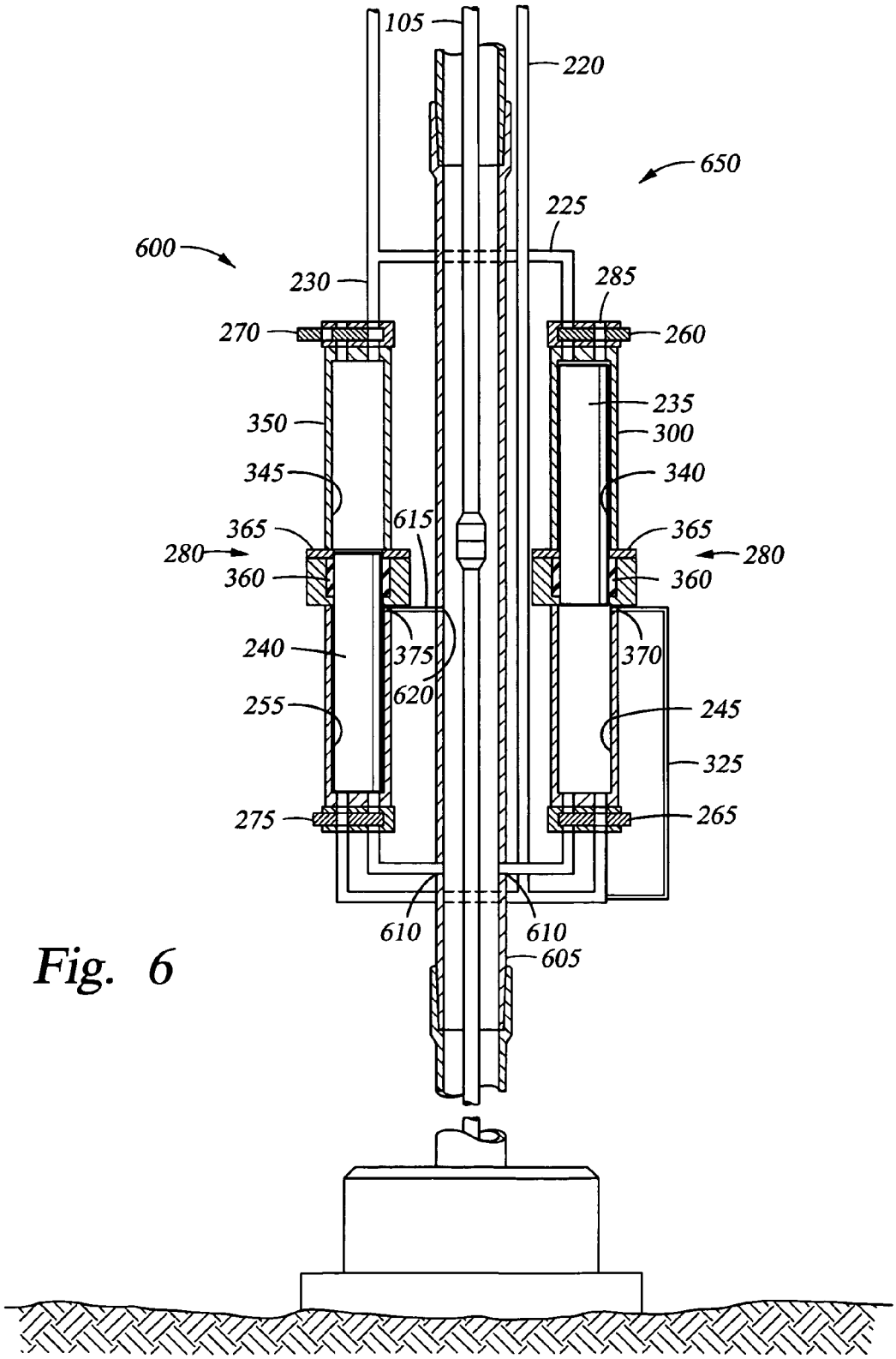
FIG. 6 is a cross-sectional view illustrating a multi-phase pump disposed on a riser system.

FIG. 6 is a cross-sectional view illustrating a multi-phase pump 600 disposed on a riser system 650. For convenience, the same number designation will be used for the components in the multi-phase pump 600 that are similar to the components in the multi-phase pump 200 as described in FIGS. 1 and 2.

As shown on FIG. 6, the first plunger 235 is moving toward the extended position as wellbore fluid and pressure enters through the valve 265 to fill the first lower chamber 245. Generally, wellbore fluid enters the multi-phase pump 600 through a fluid outlet 610 formed in a riser pipe 605. In this embodiment, the pressure of the head of drilling fluid in the riser above the fluid outlet 610 is used to urge plunger 235 upward. At the same time, power fluid in the first upper chamber 340 vents through an outlet 285 of the upper valve 260 into the surrounding sea. Simultaneously, the second plunger 240 is moving in an opposite direction toward the retracted position as power fluid from the fluid line 230 flows through valve 270 and fills the upper chamber 345, thereby expelling the wellbore fluid in the second lower chamber 255 through the lower valve 275 into the discharge line 220.

As the first plunger 235 reaches its full extended position, the second plunger 240 then reaches its retracted position, thereby completing a cycle. The first plunger 235 then moves toward the retracted position as power fluid from the fluid line 225 flows through the valve 260 and fills the upper chamber 340, thereby expelling the wellbore fluid in the lower chamber 245 into the discharge line 220, as the second plunger 240 moves toward the extended position filling the second lower chamber 255 with wellbore fluid from the fluid outlet 610. During the pump cycle, the plungers 235, 240 are constantly scraped and polished by a seal assembly 280 to eliminate solid particles thereby insuring the useful life of the multi-phase pump 600.

With respect to locating the pump 600 on the riser system 650, the sensitivity to pressure changes diminishes, since these would be absorbed by the drilling fluid head in the riser system 650 caused by split second hesitations in the pumping rate due to the reciprocating actions of the plungers 235, 240. Such changes would be hardly noticeable downhole, hence no need for the pulsation control assembly as described in FIG. 2.

The multi-phase pump 600 further includes a first gas line 325 and a second gas line 615 disposed on the first plunger assembly 300 and second plunger assembly 350, respectfully. Generally, the gas lines 325, 615 are used to prevent gas lock of the plungers 235, 240 during operation of multi-phase pump 600 and represent alternative methods of gas removal. As shown, the first gas line 325 connects an auxiliary gas port 370 at the upper end of the lower chamber 245 to the discharge line 220. Similarly, the second gas line 615 connects an auxiliary gas port 375 at the upper end of the lower chamber 255 to a riser port 620 formed in the riser pipe 605.

In a similar manner as discussed in FIGS. 3A–3F, wellbore fluid gas enters the multiphase pump 600 through the fluid outlet 610. As wellbore fluid enters the chamber 245, the vertical disposition of the plunger assembly 300 disposes the solids and liquids to remain at or near the lower portion of the chamber 245 while the gas migrates to the upper portion of the chamber 245. The natural separation of the phases permits the solids and liquids to be discharged first through the lower valve 265 into a discharge line 220. As the plunger 235 moves toward the retracted position, the plunger 235 compresses the gas until the gas pressure equals the discharge pressure in the discharge line 220. At this point, gas enters the gas line 325 and subsequently into the discharge line 220. After all the gas is vented from the lower chamber 245, the liquid rises and enters the gas line 325 and the increase in pressure then causes the liquids and solids to discharge through lower valve 275 into the discharge line 220.

The second plunger assembly 350 compresses and vents the gas out of the lower chamber 255 in a similar manner as the first plunger assembly 300. However, the gas from the second plunger assembly 350 is directed through a port 620 into the riser pipe 605 instead of the discharge line 220. Typically, a valve member (not shown) is employed between the plunger assembly 350 and the riser pipe 605 to restrict the flow of gas through the gas line 615 until the gas in the lower chamber 255 equals the discharge pressure in the discharge line 220. At this point, gas enters the gas line 615 and subsequently into the riser pipe 605.

In another aspect of the present invention, a multi-phase pump may be employed in an under balanced drilling operation of a surface wellbore to separate a gas portion of a wellbore fluid from a liquid portion.

Figure 7:
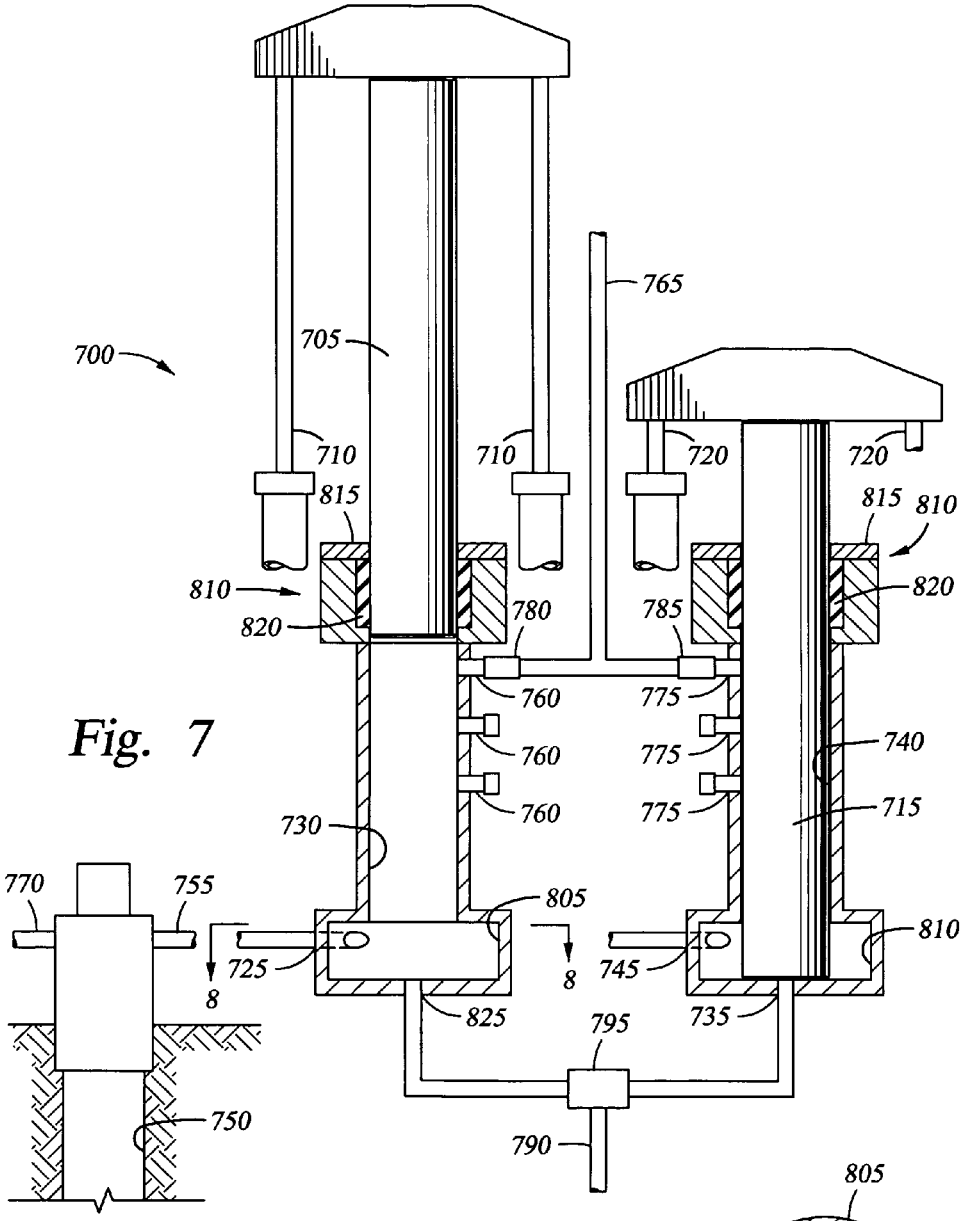
FIG. 7 is a cross-sectional view illustrating a multi-phase pump system disposed adjacent a surface wellbore.
Figure 8:
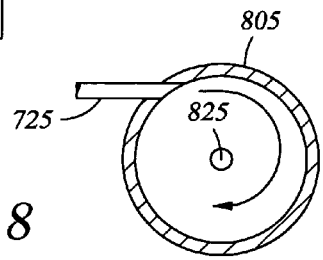
FIG. 8 is a cross-sectional view taken along line 8—8 of FIG. 7 to illustrate an enlarged chamber.

FIG. 7 is a cross-sectional view illustrating a multi-phase pump system 700 disposed adjacent a surface wellbore 750. The multiphase pump system 700 contains a first plunger 705 and a second plunger 715, each movable between an extended position and a retracted position. A first pair of hydraulic cylinders 710 controls the movement of the first plunger 705, while a second pair of hydraulic cylinders 720 controls the movement of the second plunger 715. The multiphase pump system 700 may also be operated by a single cylinder attached to each plunger 705, 715. Generally, the hydraulic cylinders 710, 720 are synchronized and operated by an external control (not shown). When the first plunger 705 moves toward the extended position, a suction is created by the plunger 705 urging the wellbore fluid from the wellbore line 755 to enter the multi-phase pump system 700. The wellbore fluid enters through an inlet 725 into an enlarged chamber 805 that is formed on a lower portion of a first plunger chamber 730. As shown in FIG. 8, the enlarged chamber 805 is a substantially circular shape and the inlet 725 is constructed and arranged to direct the wellbore fluid tangentially into the enlarged chamber 805. In this respect, the wellbore fluid enters the enlarged chamber 805 tangentially resulting in the spinning of the fluid and the creation of a centrifugal force that promotes the separation of the gas portion from the fluid portion of the wellbore fluid. In addition to the energy created by the centrifugal force, the density differential between the gas and the liquid naturally separates the two phases in the chamber 730.

Referring back to FIG. 7, as the first plunger 705 moves toward the extended position, the second plunger 715 moves in an opposite direction toward a preset retracted position, thereby expelling the wellbore fluid in a second plunger chamber 740 and the enlarged chamber 805 to an outlet 735. As the first plunger 705 reaches its full extended position, the second plunger 715 then reaches its preset retracted position, thereby completing a cycle. The first plunger 705 then moves toward the preset retracted position expelling the wellbore fluid into an outlet 825, as the second plunger 715 moves toward the extended position creating a suction and urging the wellbore fluid to enter an inlet 745. In this manner, the plungers 705, 715 operate as a pair of substantially counter synchronous fluid pumps. While the described embodiment includes plungers acting in a counter-synchronous manner, it will be understood that so long as they move in a predetermined way relative to one another, a predetermined phase relationship, the plungers can assume any position as they operate.

The hydraulic pump system 700 further includes a plurality of ports 760 in fluid communication with the plunger chamber 730 and a plurality of ports 775 in fluid communication with the plunger chamber 740. Generally, the ports 760, 775 act as a passageway to facilitate the removal of the wet gas from the chambers 730, 740 during the pump cycle. Preferably, one port 760 on the first plunger chamber 730 is in communication with one port 775 on the second plunger chamber 740 while the remaining ports 760, 775 are plugged. The percentage of liquid and the percentage of wet gas in the wellbore fluid determines which of the ports 760, 775 are used and which of the ports 760, 775 are plugged. For example, if the wellbore fluid contains a high percentage of liquid, then the upper ports 760, 775 are used. Conversely, if the wellbore fluid contains a high percentage of wet gas, then the lower ports 760, 775 are used.

Optionally, a first check valve 780 is connected to the functioning port 760 in the first plunger chamber 730 and a second check valve 785 is connected to the functioning port 775 in the second plunger chamber 740. The check valves 780, 785 are constructed and arranged to open at a predetermined pressure. In other words, the check valves 780, 785 prevent the wet gas from exiting the chambers 730, 740 until the predetermined pressure is reached. At that time, the wet gas flows through the ports 760, 775 into a wet gas line 765. In addition, the check valves 780, 785 prevent the wet gas from returning to the chambers 730, 740 after it exits through the ports 760, 775.

As shown on FIG. 7, the upper ports 760, 775 are in communication with the wet gas line 765. The wet gas leaving the multiphase pump system 700 is typically at a low pressure. Therefore, it would be desirable to increase the pressure of the wet gas. However, the wet gas may include three different phases, namely, solid, liquid, and wet gas. Therefore, a second multiphase pump (not shown) may be connected to the wet gas line 765 to boost the pressure of the wet gas. Even though the wet gas contains three phases, the second multiphase pump may effectively increase the pressure of the wet gas in the wet gas line 765 and then recycle the wet gas back to a well inlet 770. Further, the second multiphase pump will allow recovery or recycling of low pressure gas. In this manner, valuable wellbore fluid gas such as nitrogen and natural gas may be recycled and/or recaptured. Additionally, a flare line (not shown) may be connected to the wet gas line 765. The flare line may be used to discharge excess wet gas in the wet gas line 765. Alternatively, the flare line may direct the excess wet gas to a flare stack or a collecting unit for other manners of disposal.

Similar to the wet gas line 765, a fluid line 790 is disposed at the lower end of the hydraulic pump system 700. A control 795 is connected between the outlets 735, 825 and the fluid line 790 to control the timing and amount of fluid discharge. Preferably, the control 795 includes a flow meter or a feed back loop that controls the fluid flow based upon the pressure differential of the fluid. For instance, if the control 795 senses that wet gas from the chambers 730, 740 is being discharged through the outlets 735, 825 then the control 795 will close the outlets 735, 825 to force the wet gas through the ports 760, 775 and eventually into the wet gas line 765. On the other hand, if the control 795 senses that fluid from the chambers 730, 740 is being discharged through the outlets 735, 825 then the control 795 will keep the outlets 735, 825 open so that all the fluid in the multiphase pump system 700 exits into the fluid line 790. The exiting fluid may be recycled for use during the drilling operation or be sent to a secondary separator (not shown) to separate out any gas remaining in the fluid before delivering it to another fluid supply (not shown).

The multi-phase pump system 700 further includes a single seal assembly 810 disposed around the plungers 705, 715 to accommodate mud and solids as well as liquids. This seal assembly 810 includes a method to constantly scrape and polish the plungers 705, 715 and can eliminate solid particles from the seal assembly 810 area, thereby insuring its useful life and protecting the sealing elements. Generally, the seal assembly 810 includes a plurality of rings 815 that are disposed on either side of a sealant 820. During the operation of the multi-phase pump system 700, the rings 815 scrape and polish the plungers 705, 715. Typically, the sealant 820 is replenished by a mechanism well known in the art. Alternatively, the sealant may also be remotely injected during pump operations to replenish and improve its life expectancy. As further illustrated in this embodiment, there is minimal tolerance between the outside diameter of the plungers 705, 715 and the inner diameter of the chambers 730, 740. This arrangement permits the plungers 705, 715 to expel the entire amount of wet gas and fluid to their respective outlets 735, 825.

Figure 9:
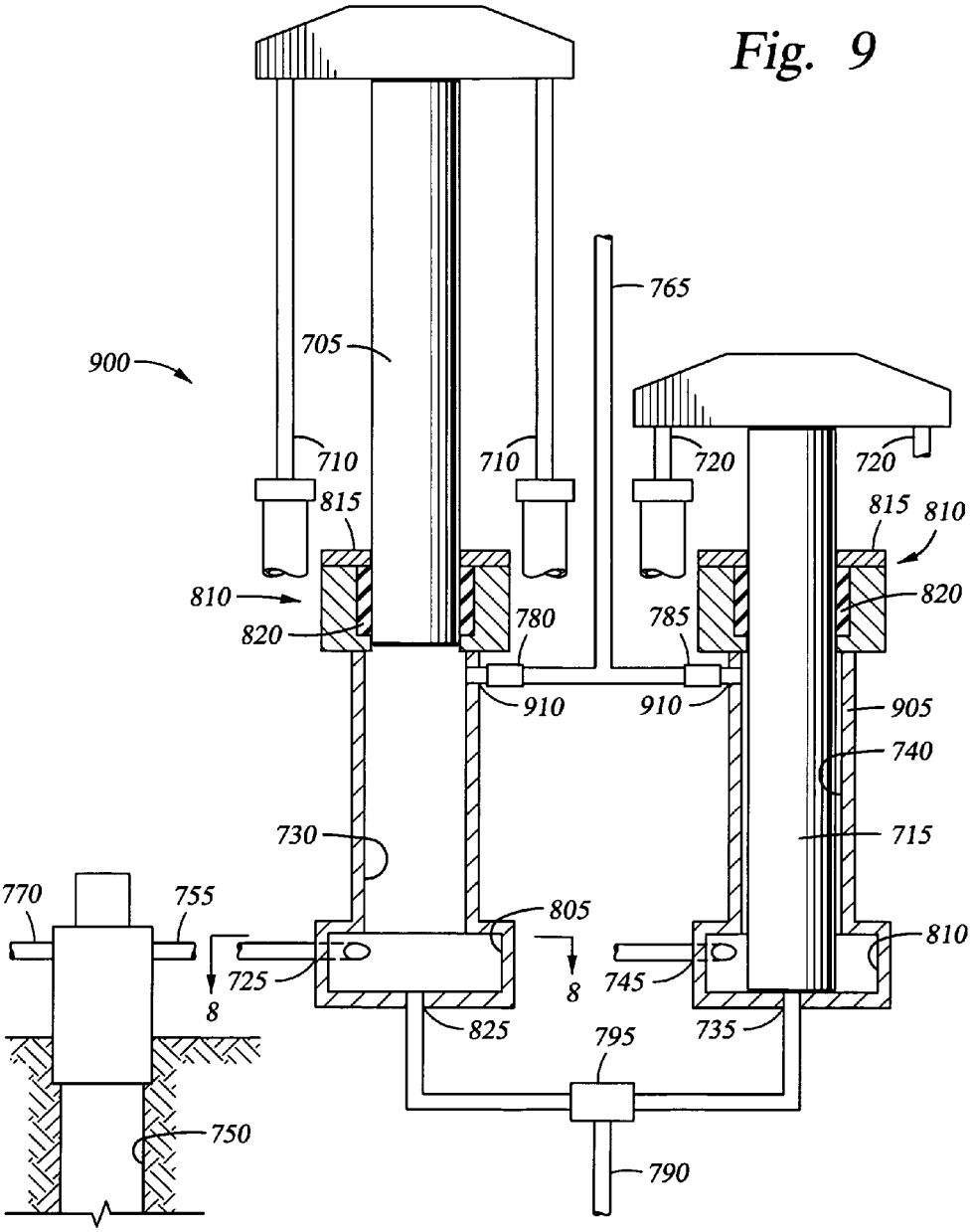
FIG. 9 is a cross-sectional view illustrating an alternative embodiment of a multi-phase pump system for use with a surface wellbore.

FIG. 9 is a cross-sectional view illustrating an alternative embodiment of a multi-phase pump system 900 for use with a surface wellbore 750. For convenience, the same number designation will be used for the components in the multi-phase pump system 900 that are similar to the components in the multi-phase pump system 700 as described in FIG. 7.

As shown in FIG. 9, the multi-phase pump system 900 has similar components and operates in a similar manner as the multi-phase system 700. The multiphase pump system 900 contains a first plunger 705 and a second plunger 715, each movable between an extended position and a retracted position. In this respect, the plungers 705, 715 operate as a pair of substantially counter synchronous fluid pumps. However in this embodiment, an annulus 905 is created between the outside diameter of the plungers 705, 715 and the inner diameter of the chambers 730, 740. This arrangement permits wet gas to fill the annulus 905 as the plungers 705, 715 alternately move toward in their extended position. The wet gas in the annulus 905 then becomes pressurized as the plungers 705, 715 alternately move to their retracted position. The gas in the annulus 905 increases in pressure until the predetermined pressure of the check valve 780 is reached. At that point, the wet gas is permitted to exit through a wet gas outlet 910 and subsequently into the wet gas line 765.

Figure 10:
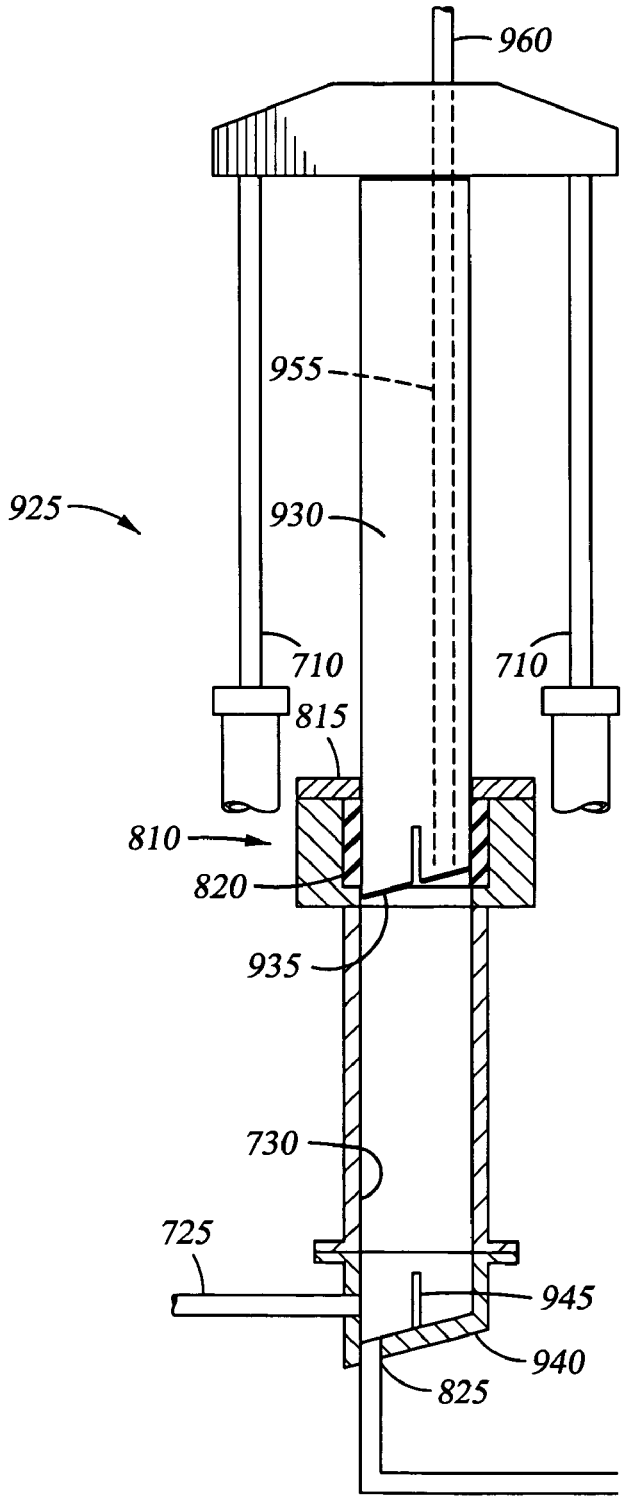
FIG. 10 is a cross-sectional view illustrating an alternative embodiment of a multi-phase pump system.

FIG. 10 is a cross-sectional view illustrating an alternative embodiment of a multi-phase pump system 925. For convenience, the same number designation will be used for the components in the multi-phase pump system 925 that are similar to the components in the multi-phase pump system 700 as described in FIG. 7.

As shown in FIG. 10, the multi-phase pump system 925 has similar components and operates in a similar manner as the multi-phase system 700. However in this arrangement, the pump system 925 includes a plunger 930 having a tapered end 935 that is constructed and arranged to mate with a tapered removable bottom 940 having a deflector plate 945 attached thereto. Additionally, a gas hose 960 is operatively attached to a plunger bore 955. As the plunger 930 moves upward, wellbore fluid enters the inlet 725 and contacts the deflector plate 945. At this point, the solids and liquids migrate toward a lower end of the tapered removable bottom 940 while the gas migrates towards the top of the plunger chamber 730. As the plunger 930 moves downward, the gas exits through the plunger bore 955 into the gas hose 960 while the solids and liquids are discharged through the outlet 825. Preferably, a control arrangement (not shown) closes the flow path through the plunger bore 955 as the solids and liquids are discharged.

Figure 11:
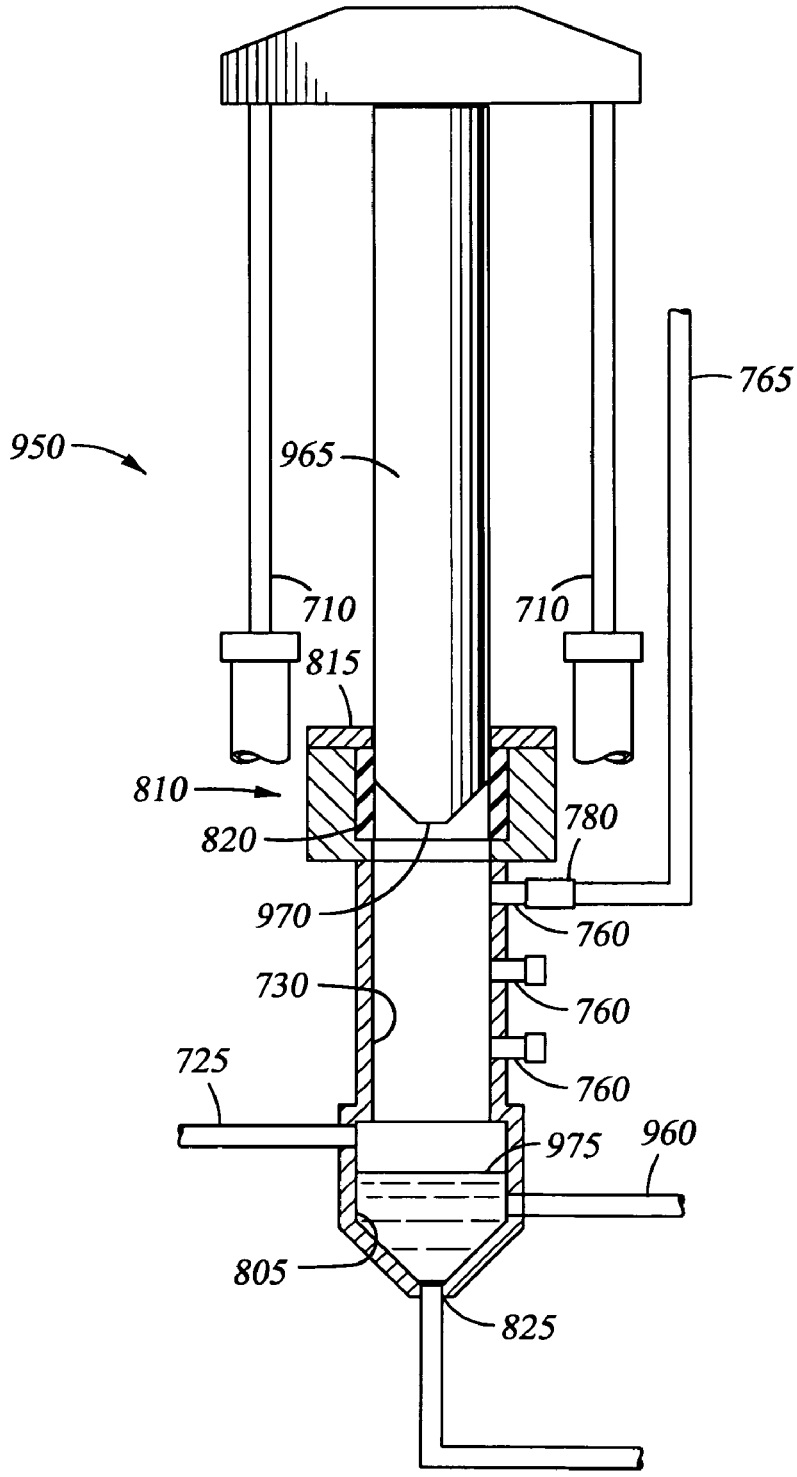
FIG. 11 is a cross-sectional view illustrating an alternative embodiment of a multi-phase pump system.

FIG. 11 is a cross-sectional view illustrating an alternative embodiment of a multi-phase pump system 950. For convenience, the same number designation will be used for the components in the multi-phase pump system 950 that are similar to the components in the multi-phase pump system 700 as described in FIG. 7.

As shown in FIG. 11, the multi-phase pump system 950 has similar components and operates in a similar manner as the multi-phase system 700. However, in this arrangement, a liquid level 975 is maintained at a predetermined level in the enlarged chamber 805. The primary reason for maintaining the liquid level 975 is to minimize the amount of gas discharge through the outlet 825.

During operation, wellbore fluid enters through the inlet 725 as a plunger 965 moves upward. The plunger 965 includes a tapered end 970 that is constructed and arranged to mate with a tapered profile 980 formed at the lower end of the enlarged chamber 805. Thereafter, the solids and liquids migrate toward the bottom of the enlarged chamber 805, while the gas migrates into the plunger chamber 730. At the same time, the liquid level 975 is monitored by a control mechanism (not shown), such as a level sensor, valve arrangement, or other means well known in the art. If the control mechanism senses that the liquid level 975 is above the predetermined level, then a liquid outlet 985 opens to permit excess liquid to drain out of the enlarged portion 805. Conversely, if the control mechanism senses that the liquid level is below the predetermined level, the liquid outlet 960 remains closed to permit additional liquid buildup in the enlarged portion 805.

As the plunger 965 descends, the plunger 965 compresses the gas in the plunger chamber 730 and displaces it into the liquid in the enlarged portion 805. As the displaced liquid rises in the plunger chamber 730, the gas will compress further until the valve 780 opens, thereby allowing the gas to exit the plunger chamber 730 into the wet gas line 765. Typically, the liquid will rise in the plunger chamber 730 to a point just below the activated gas port 760. Subsequently, a check valve (not shown) opens and allows a slurry comprising of the solids and a portion of the liquid to be discharged through the outlet 825. Preferably, the slurry flows into a separator (not shown) to separate the liquids from the solids. At this point, the liquids may be recycled back into the multi-phase pump system 950 to maintain the liquid level 975.

While the foregoing is directed to embodiments of the present invention, other and further embodiments of the invention may be devised without departing from the basic scope thereof, and the scope thereof is determined by the claims that follow.

The invention claimed is:

1. A method of drilling a subsea wellbore, comprising: circulating a drilling fluid through a first flow path to a drill bit in the wellbore, the fluid flowing upwards in a second flow path within the wellbore; and pumping the fluid and drill cuttings from the second flow path to a fluid handling system having at least two plungers operating in a predetermined phase relationship.

2. The method of claim 1, wherein the at least two plungers operate substantially counter synchronously.

3. The method of claim 2, wherein the plungers are moved in a first direction by the fluid and in a second direction by power fluid provided from the surface.

4. The method of claim 1, wherein the fluid handling system is disposed at a sea floor.

5. The method of claim 1, wherein the fluid handling system is disposed on a riser at a location between the surface and a sea floor.

6. A method of transporting cuttings from a subsea wellbore, comprising: urging the cuttings in a fluid slurry from an annular area in the wellbore to a pump assembly in fluid communication with the wellbore; utilizing the slurry to operate at least one plunger member of the pump assembly in a first direction; and utilizing a power fluid to operate the at least one plunger in a second direction, thereby pumping the slurry towards the surface of the sea.

7. A method of reducing equivalent circulating density in a subsea wellbore, comprising: pumping a fluid through a drill pipe from a surface of water to a drill bit in a wellbore; circulating the fluid and cuttings to the top of the wellbore; and adding energy to the fluid and cuttings with a multi-phase pump, thereby urging the fluid and cuttings to the surface.

8. The method of claim 7, wherein the multi-phase pump includes at least two plungers operating in a predetermined phase relationship.

9. The method of claim 8, wherein plungers operate substantially counter synchronously.

10. A sub-sea fluid pumping system, comprising: a pair of substantially counter synchronous fluid pumps locatable adjacent a sub-sea wellbore and in fluid communication with an annulus therein; at least one fluid path for communicating wellbore fluid between the annulus and the fluid pumps; and at least one power fluid line for providing power fluid to the fluid pumps.

11. The system of claim 10, wherein the pair of substantially counter synchronous fluid pumps are a pair of plungers, each plunger movable between an extended position and a retracted position.

12. The system of claim 11, wherein the wellbore fluid urges the plunger to the extended position.

13. The system of claim 11, further including a control line for providing a fluid to urge the plunger to the extended position.

14. The system of claim 11, wherein the power fluid urges the plunger to the retracted position.

15. The system of claim 11, further including a seal assembly disposed around each plunger to constantly scrape and polish each plunger as it moves between the extended position and the retracted position.

16. The system of claim 15, wherein the seal assembly includes a plurality of rings disposed on either side of a sealant.

17. The system of claim 16, wherein the sealant is remotely injected during the operation of the fluid pumps.

18. The system of claim 10, further including a pulsation control assembly to control the back pressure in a sub-sea wellbore due to the movement of the pair of substantially counter synchronous fluid pumps.

19. The system of claim 18, wherein the pulsation control assembly includes an accumulator piston disposed in a gas filled accumulator.

20. The system of claim 10, further including a plurality of upper valves to control the amount of power fluid to the pair of fluid pumps.

21. The system of claim 10, further including a plurality of lower valves to control the amount of wellbore fluid entering the pair of fluid pumps and the amount of discharge fluid exiting the pair of fluid pumps.

22. The system of claim 10, wherein the fluid pumps are operatively connected to a guide base.

23. The system of claim 22, wherein the fluid pumps may be individually inserted and retrieved from the guide base.

24. The system of claim 10, further including a gas line for removing gas from the pair of fluid pumps to prevent gas lock during a pump cycle.

25. The system of claim 10, wherein the fluid pumps are operatively connected to a riser pipe.

26. A sub-sea fluid pumping system, comprising: a pair of substantially counter synchronous fluid pumps disposed on a riser pipe at a location between a surface and a sea floor, whereby the fluid pumps are in fluid communication with an annulus of a sub-sea wellbore; at least one fluid path for communicating wellbore fluid between the annulus and the fluid pumps; and at least one power fluid line for providing power fluid to the fluid pumps.

27. The system of claim 26, wherein the pair of substantially counter synchronous fluid pumps are a pair of plungers, each plunger movable between an extended position and a retracted position.

28. The system of claim 26, wherein the fluid pumps may be individually inserted and retrieved from the riser pipe.

* * * * *